US005788519A

United States Patent [19]

Stern

[11] Patent Number: 5,788,519

[45] Date of Patent: Aug. 4, 1998

[54] WATERPROOF GROUNDING CONNECTOR AND METHOD OF ASSEMBLING SAME

[75] Inventor: Eric Joseph Stern, Farmington Hills, Mich.

[73] Assignee: Yazaki Corporation, Tokyo, Japan

[21] Appl. No.: 784,455

[22] Filed: Jan. 16, 1997

Related U.S. Application Data

[63] Continuation of Ser. No. 433,244, May 2, 1995, abandoned.

[51] Int. Cl.[6] ..... H01R 29/00

[52] U.S. Cl. ..... 439/189; 439/939

[58] Field of Search ..... 439/92, 98, 99, 439/108, 189, 278, 509, 511, 587, 939, 97

[56] References Cited

U.S. PATENT DOCUMENTS

| | | | |
|---|---|---|---|
| 4,952,155 | 8/1990 | Kuzuno et al. | 439/189 X |
| 5,000,699 | 3/1991 | Nadin | 439/189 X |
| 5,040,999 | 8/1991 | Collier | 439/108 |
| 5,079,671 | 1/1992 | Garrett et al. | 439/108 X |
| 5,145,410 | 9/1992 | Maejima et al. | 439/587 |
| 5,201,667 | 4/1993 | Endo et al. . | |
| 5,326,275 | 7/1994 | Murakami | 439/189 |
| 5,356,302 | 10/1994 | Inoue et al. | 439/189 |
| 5,403,211 | 4/1995 | Sayer et al. . | |
| 5,425,656 | 6/1995 | Wakata . | |
| 5,496,188 | 3/1996 | Okamura et al. | 439/189 |

FOREIGN PATENT DOCUMENTS 60-16039 5/1985 Japan .

*Primary Examiner*—Neil Abrams
*Assistant Examiner*—Katrina Davis
*Attorney, Agent, or Firm*—Young & Basile, P.C.

[57] ABSTRACT

A waterproof grounding connector is securable to a grounding surface and capable of receiving a plurality of electrical terminals in a sealing relationship. The waterproof grounding connector includes a connector body having opposite first and second ends, and a plurality of parallel longitudinal chambers extending through the connector body. Each chamber is adapted to receive an electrical terminal. A lock means is provided to secure the electrical terminals within the chambers. A hollow, peripheral shroud is located at the second end of the connector body and defines an enclosure having an internal peripheral surface. A flexible grommet with a continuous peripheral edge is adapted to be inserted into the shroud enclosure and creates a continuous peripheral seal between the grommet edge and the internal shroud surface. The grommet includes a plurality of slots which correspond to and align with the chambers. A conductive busbar contains a base portion with a plurality of perpendicularly extending blades which penetrate the grommet slots in a sealing relationship. The busbar blades correspond to and align with the chambers. A mounting tab extends from the base portion of the busbar for mounting the busbar to the grounding surface. A means is provided to secure the grommet and the busbar within the connector body.

17 Claims, 5 Drawing Sheets

FIG-6
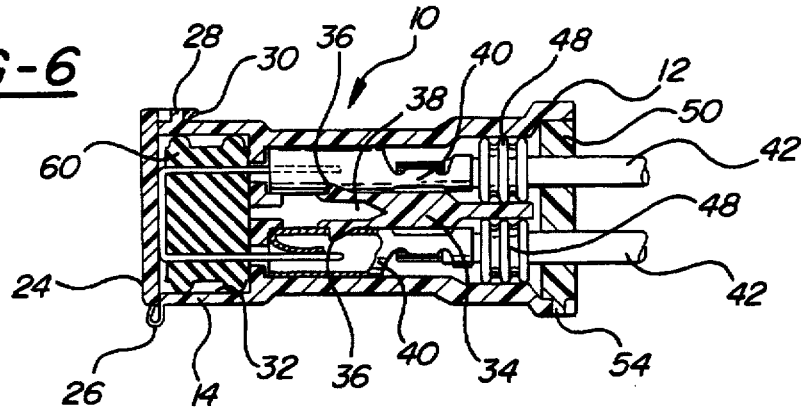
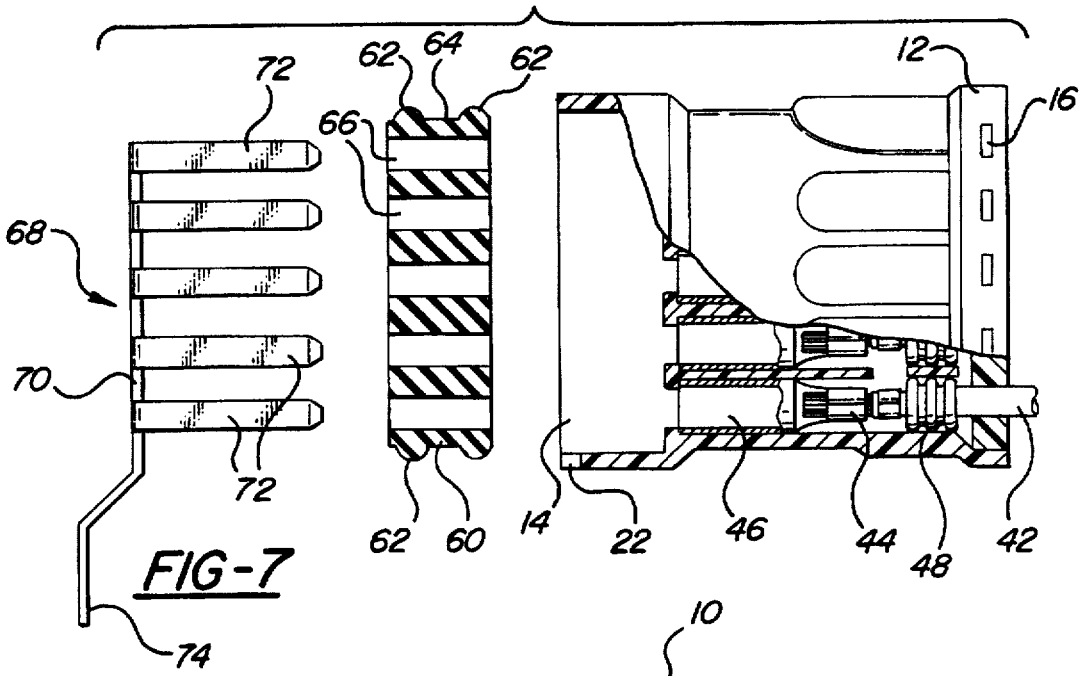
FIG-7
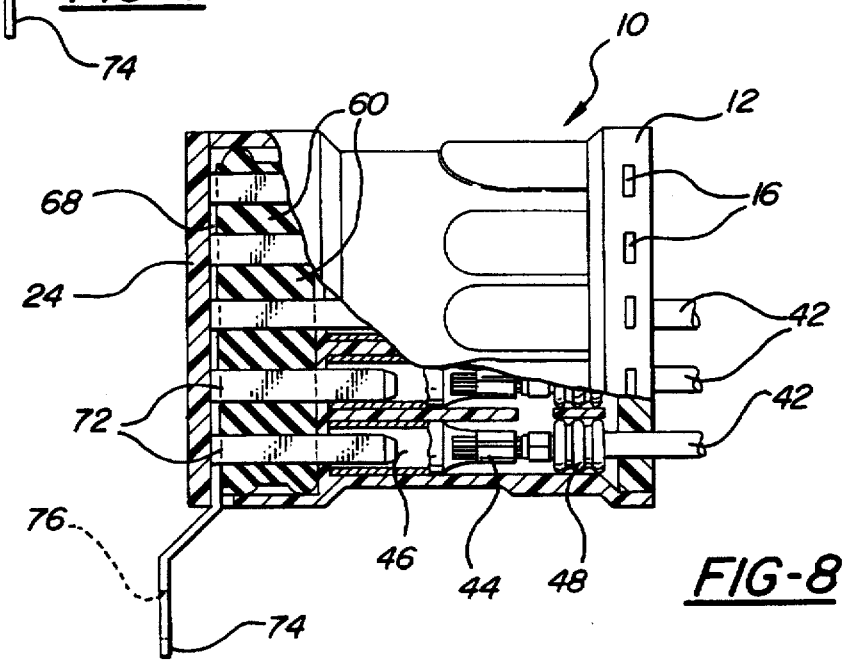
FIG-8

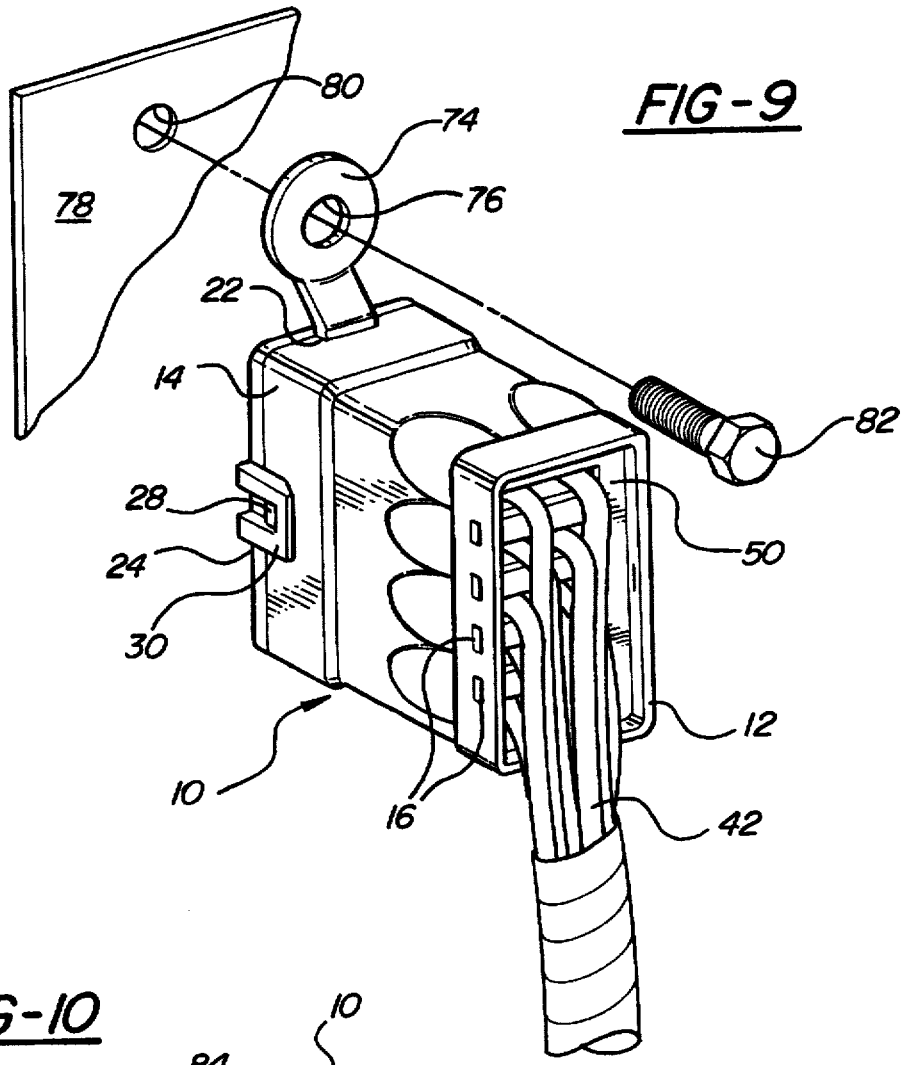
FIG-9
FIG-10
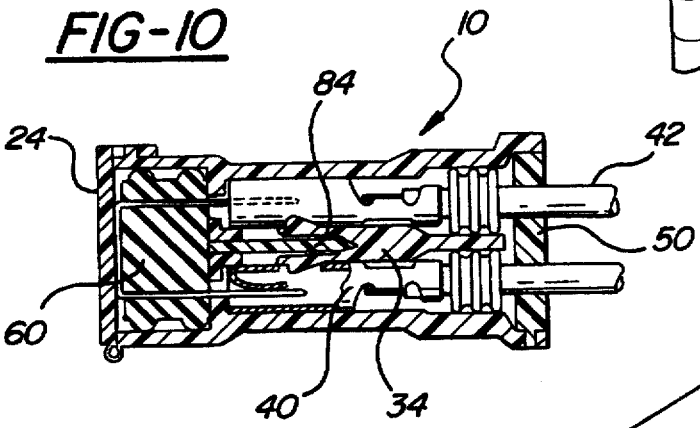
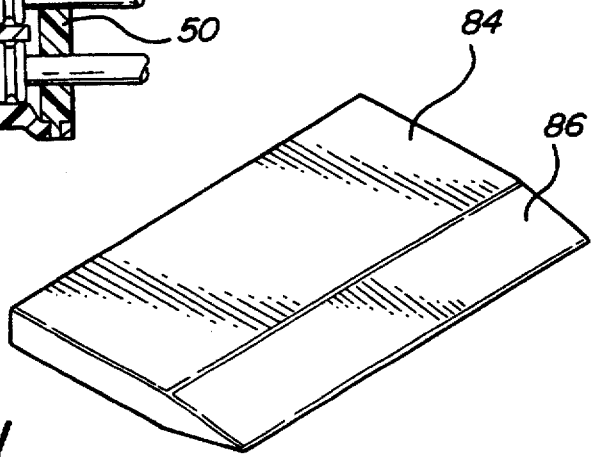
FIG-11

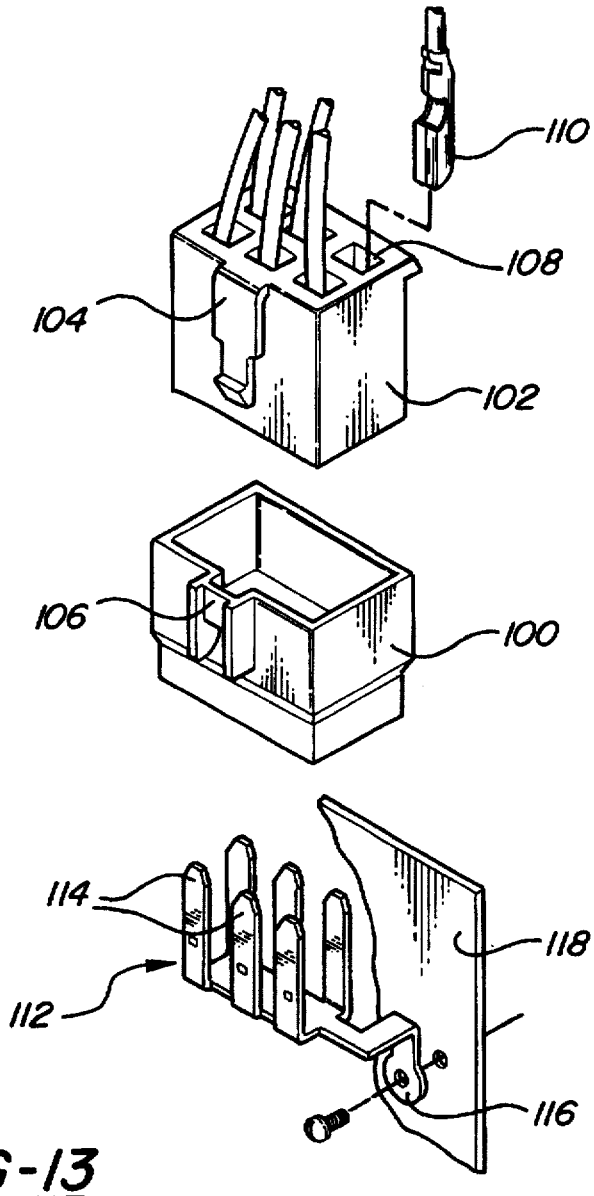
FIG-12
PRIOR ART
FIG-13
PRIOR ART
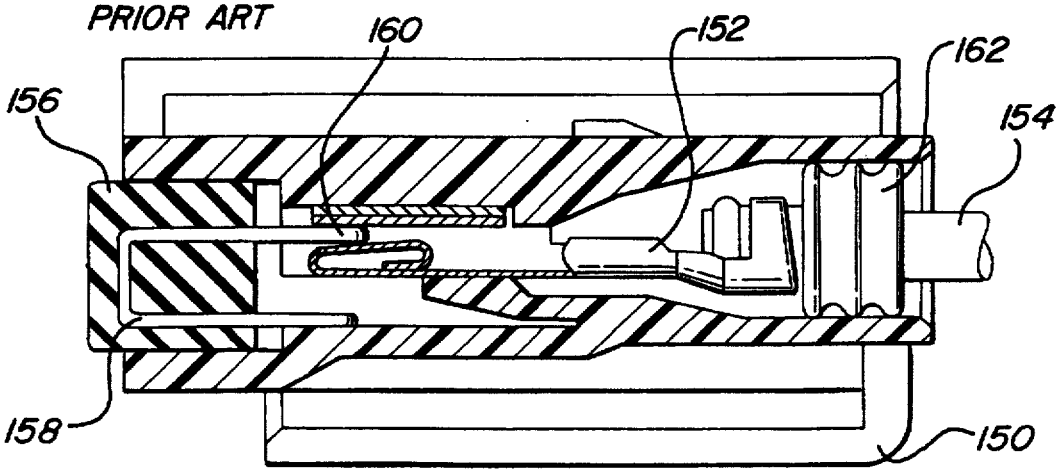

WATERPROOF GROUNDING CONNECTOR AND METHOD OF ASSEMBLING SAME

This is a continuation of application Ser. No. 08/433,244 filed on May 2, 1995, now abandoned.

FIELD OF THE INVENTION

The present invention relates to a waterproof grounding connector for receiving and grounding a plurality of electrical terminals.

BACKGROUND OF THE INVENTION

Grounding connectors are used in vehicle electrical systems to provide a common electrical ground for electrical circuits within the vehicle. The grounding connector is electrically connected to a grounded vehicle surface such as a body panel. Typically, these grounding connectors are located in the vehicle's engine compartment, and are therefore exposed to dirt, water, salt, and other contaminants. These contaminants in the engine compartment may cause the electrical contact surfaces in the grounding connector to corrode. Corrosion of the electrical contact surfaces increases the electrical resistance between the contact surfaces, thereby reducing the effectiveness of the grounding connection. As the contact surfaces continue to corrode, the electrical resistance increases and eventually reaches a level where the grounding connection is effectively an open circuit. At this point, the electrical circuits connected to the grounding connector do not have an adequate electrical ground, causing the vehicle's electrical circuits to malfunction.

One type of known grounding connector is shown in FIG. 12. This connector includes a frame 100, a connector body 102, and a busbar 112. Connector body 102 and connector frame 100 are secured together by the interaction between tab 104 and latch 106. Connector body 102 contains a plurality of apertures 108 which receive electrical terminals 110. Busbar 112 contains a mounting tab 116 and a plurality of fingers 114. Busbar 112 is mounted to panel 118. The grounding connector shown in FIG. 12 does not provide a waterproof seal. In an attempt to reduce corrosion on the electrical contact surfaces of fingers 114 and terminals 110, grease is applied to the contact surfaces. However, the grease is generally applied inconsistently, and may not fully cover all electrical contact surfaces. Additionally, the grease is not permanent and may be forced away from the electrical contact surfaces due to water pressure, air pressure or movement between the contact surfaces. Furthermore, certain greases have been known to deteriorate the wire insulation, thereby causing corrosion of the wire itself.

Another prior art grounding connector is described in U.S. Pat. No. 5,201,667, a drawing of which is provided in FIG. 13. As shown in FIG. 13, the grounding connector includes a connector body 150 which receives a plurality of electrical terminals 152 attached to wires 154. A flexible portion 156 contains a short circuit element 158 which includes a plurality of electrical contact fingers 160 for engaging terminals 152. A cable seal 162 is located around each wire and seals the opening into which terminal 152 is inserted. Although the connector shown in FIG. 13 provides sealing members 156 and 162, it does not contain any type of lock mechanism to secure flexible portion 156 within the connector body. Thus, if flexible portion 156 is inserted first, the force applied when urging terminals 152 into connector body 150 may cause flexible portion 156 to be released from the connector body. Furthermore, the structure shown in FIG. 13 does not provide a grounding tab for mounting short circuit element 158 to the grounding surface. Instead, one of the attached electrical terminal wires 154 must be routed to and connected with the grounding surface. Therefore, rather than providing a busbar-type connection to the grounding surface, a single wire is used which, if broken or disconnected, eliminates the grounding connection for all electrical circuits. Also, since flexible portion 156 and short circuit member 158 must be formed as a single unit, manufacturing costs are increased.

SUMMARY OF THE INVENTION

The present invention provides a waterproof grounding connector securable to a grounding surface and adapted to receive a plurality of electrical terminals. The connector includes a connector body having opposite first and second ends and a plurality of parallel, longitudinal chambers which extend through the connector body. Each chamber includes a lock means for receiving and securing the electrical terminals within the chamber. A hollow, peripheral shroud is located at the second end of the connector body and provides an enclosure with an internal peripheral surface. A flexible grommet is adapted to be inserted into the shroud enclosure. The grommet contains a continuous peripheral edge which creates a continuous peripheral seal between the grommet edge and the internal shroud surface. The grommet further contains a plurality of slots which correspond to and align with each of the chambers. A conductive busbar has a base portion with a plurality of blades extending perpendicularly from the base portion and penetrating the grommet slots in a sealing relationship. A mounting tab extends from the base portion of the busbar and is used to mount the busbar to the grounding surface. The busbar blades correspond to and align with the chambers, thereby causing the blades to engage the electrical terminals which are secured within the chambers. A mechanism is provided to secure the grommet and the busbar within the connector body.

The grommet provides a waterproof seal at the second end of the connector body and prevents water or other contaminants from reaching the electrical contact surfaces of the busbar blades or the electrical terminal. Cable seals placed around the electrical terminal wire seal the opening of each chamber to prevent entry of water or moisture from the first end of the connector.

In the preferred form, the locking means which secures the electrical terminals within the chambers comprises a locking spacer which is adapted to securely engage the first end of the connector body, thereby securing the electrical terminals within the chambers. The locking spacer has a base portion and a plurality of fingers which extend perpendicularly from the base portion. A tab extends from the base portion and a protrusion extends from the end of each finger. A peripheral skirt located at the first end of the connector body has a plurality of apertures which are adapted to receive the tab and protrusions on the locking spacer. The engagement between these apertures, tabs and protrusions secures the spacer to the connector body.

In another aspect of the preferred embodiment, a plurality of resilient locking arms are located within the connector body and engage the electrical terminals to secure the terminals within the chambers. Each resilient locking arm includes an outwardly extending protrusion which engages an aperture located in the electrical terminal. This locking engagement between the protrusion and the terminal aperture secures the electrical terminal within the chamber.

In the preferred form, the flexible grommet has a pair of parallel, spaced apart continuous peripheral ridges which extend outwardly from the peripheral edge of the grommet. These peripheral ridges provide a waterproof seal between the grommet and the internal shroud surface. The ridges extend outwardly from the grommet such that the grommet's outer dimensions are larger than the opening provided by the shroud enclosure. Therefore, insertion of the grommet into the shroud enclosure compresses the grommet, thereby creating an improved seal between the shroud and the grommet. Furthermore, as the busbar blades are inserted through the grommet slots, the grommet is urged outwardly against the internal shroud surface, thereby improving the sealing engagement between the peripheral grommet edge and the internal shroud surface.

In the preferred form, the grommet and busbar are secured within the connector body using a cover which is adapted to overlay the shroud enclosure and can be displaced between an open position and a closed position. A hinge is integrally molded between the shroud and the cover to permit movement of the cover. A lock projection extends outwardly from the outer surface of the shroud, and a latch extends from the cover and contains an aperture which engages the lock projection. When the latch and lock projection are engaged, the cover is locked in the closed position, thereby securing the grommet and busbar within the connector body.

Preferably, the shroud enclosure contains a notch to permit routing the busbar mounting tab through the shroud for attachment to the grounding surface.

Since the grounding connector provides a watertight seal, moisture and other contaminants are prevented from reaching the electrical contact surfaces within the connector. Thus, corrosion of the electrical contact surfaces is reduced, thereby maintaining the integrity of the ground connection for the attached electrical circuits. Furthermore, the cover prevents the grommet and busbar from being inadvertently released from the connector body or loosened during installation or removal of the electrical terminals.

Since the grommet and busbar are separate pieces, manufacturing costs are reduced. The busbar mounting tab provides a sturdy connection between the busbar and the grounding surface thereby increasing the integrity of the grounding connections. Thus, a single electrical terminal becoming disconnected from the grounding connector does not affect the ground connection to the remaining terminals.

BRIEF DESCRIPTION OF THE DRAWINGS

FIG. 6 is a side cross-sectional view of the assembled connector in the closed position;

FIG. 7 is a partially exploded top view of the inventive connector shown in partial cross section;

FIG. 8 is a top view of the assembled connector shown in partial cross section;

FIG. 9 is a perspective view of the assembled connector, mounting bolt, and grounding surface;

FIG. 10 is a side cross-sectional view of an alternate embodiment of the invention;

FIG. 11 is a perspective view of an alternate spacer as used with the present invention;

FIG. 12 is an exploded perspective view of a prior art grounding connector; and

FIG. 13 is a side cross-sectional view of a prior art grounding connector.

DETAILED DESCRIPTION OF THE PREFERRED EMBODIMENT

Figure 1:
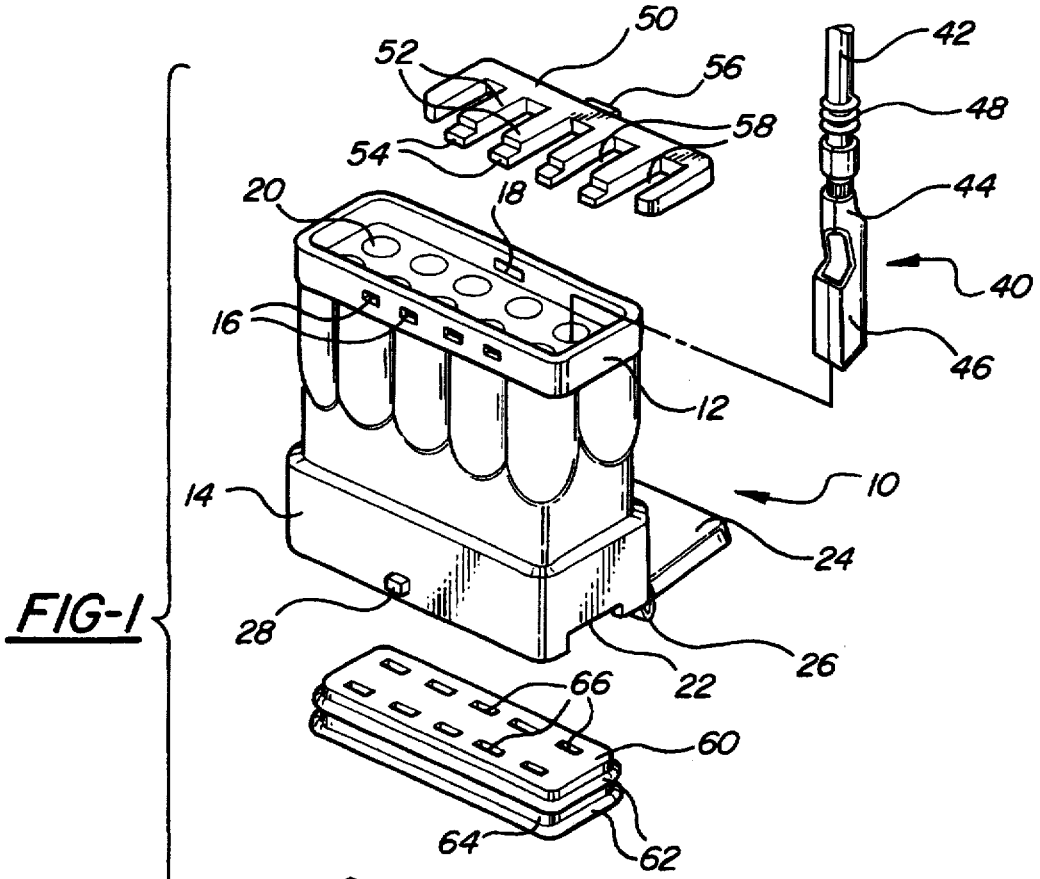
FIG. 1 is an exploded perspective view of the waterproof grounding connector.
Figure 3:
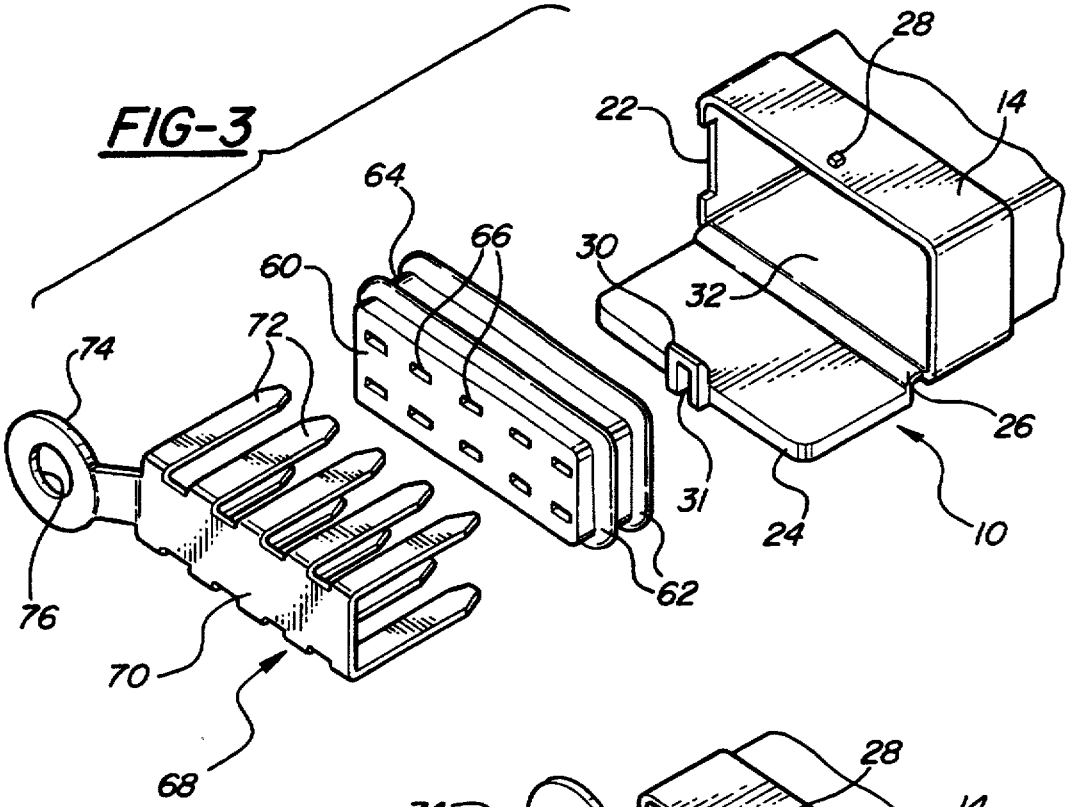
FIG. 3 is an exploded perspective view of a portion of the inventive connector, illustrating the connector body, busbar and grommet.

Referring to FIG. 1, an exploded view of the inventive waterproof grounding connector is shown. The grounding connector includes a connector body 10 having an integrally molded peripheral skirt 12 at a first end and an integrally molded peripheral shroud 14 at the opposite, second end. Shroud 14 defines a hollow enclosure , as shown in FIG. 3. Peripheral skirt 12 includes a plurality of apertures 16 located along one side of the skirt and a single aperture 18 through the opposite side of the skirt. In the preferred embodiment, connector body 10 is manufactured from a plastic material such as polypropylene.

A plurality of parallel, longitudinal chambers 20 extend through connector body 10. Each chamber 20 is adapted to receive a corresponding electrical terminal 40. Terminal 40 is inserted into the first end of connector body 10, as shown in FIG. 1. A cover 24 is attached to shroud enclosure 14 with an integrally molded hinge 26. Cover 24 is thus pivotable between an open position (shown in FIG. 1) and a closed position (shown in FIG. 5). Cover 24 has dimensions such that in the closed position, the cover overlies the open end of shroud 14.

Figure 5:
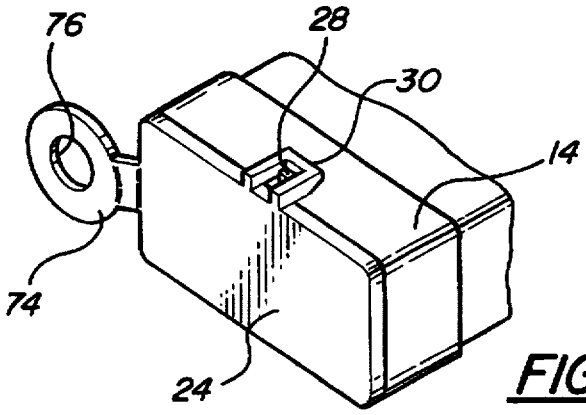
FIG. 5 is a perspective view of the assembled connector with the cover in the closed position.

Referring to FIG. 3, cover 24 includes an outwardly extending latch 30 containing an aperture 31. Latch 30 is integrally molded to the peripheral edge of cover 24. A lock projection 28 extends outwardly from the outer surface of shroud 14 and is adapted to engage aperture 31 in latch 30 as shown in FIG. 5.

As shown in FIG. 3, shroud 14 has a continuous peripheral internal surface 32. A resilient, silicone rubber grommet 60 is inserted into shroud 14, and forms a water-tight seal between the grommet and internal surface 32. Grommet 60 contains a pair of peripheral ridges 62 extending outwardly from the peripheral edge of the grommet. A peripheral channel 64 is formed between the pair of ridges 62 and extends around the peripheral edge of grommet 60. In the preferred form, grommet 60 has an outer dimension which is slightly larger than the opening in shroud 14, thereby requiring compression of the grommet during insertion into the shroud. This compression creates a tight fit between shroud 14 and grommet 60.

Grommet 60 further includes a plurality of slots 66 extending through the grommet. The number of slots 66 in grommet 60 correspond to the number of chambers 20 in connector body 10. Furthermore, slots 66 are in alignment with chambers 20.

A conductive busbar 68 contains a flat base portion 70, a plurality of blades 72 extending perpendicularly from the base portion, and a mounting tab 74 extending from the base portion. Mounting tab 74 includes an aperture 76 adapted to receive a screw, mounting bolt, rivet, or other device to secure the busbar to the grounding surface (as shown in FIG. 9). Bus bar blades 72 correspond with the number of grommet slots 66 and the number of chambers 20 in connector body 10. Additionally, blades 72 are in alignment with chambers 20 and grommet slots 66. Busbar blades 72 are insertable through grommet slots 66 and into chambers 20. The distal end of each blade 72 is slightly tapered to permit easier insertion through grommet slot 66. Each blade 72 is slightly larger than the opening provided by slot 66, thereby creating a tight fit between grommet 60 and busbar 68. Shroud 14 contains a notch 22 through which mounting tab 74 is routed. Preferably, busbar 68 is manufactured from a rigid, conductive metal material.

Referring again to FIG. 1, electrical terminals 40 are inserted into chambers 20. Each electrical terminal 40 is connected to a wire 42 using crimp tabs 44. Various types of crimp tabs 44 may be used to secure terminal 40 to wire 42, as will be known to those skilled in the art. Each electrical terminal 40 contains an electrical contact portion 46 at the distal end. Electrical contact portion 46 defines an opening which is adapted to receive and securely engage busbar blades 72. The engagement between electrical contact portion 46 and busbar blade 72 provides a secure electrical connection. A resilient cable seal 48 is located around each wire 42 near crimp tab 44. Cable seal 48 has a diameter which is slightly larger than the diameter of chamber 20, thereby creating a seal between the internal surface of the chamber and the cable seal. Cable seal 48 is secured to cable 42 using crimp tabs 44.

Figure 2:
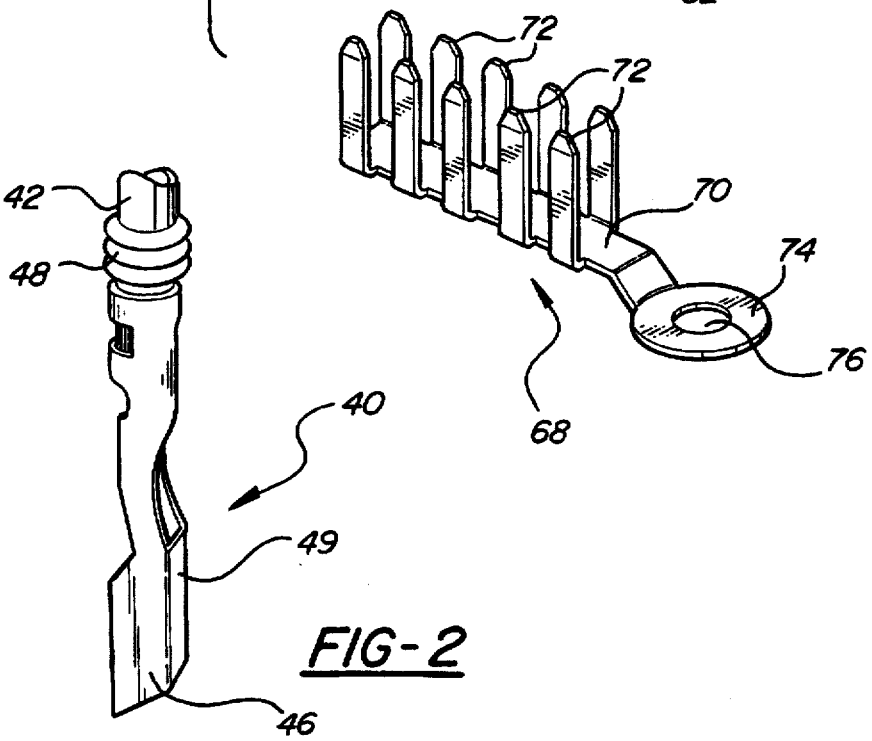
FIG. 2 is a perspective view of a single electrical terminal.

Referring to FIG. 2, a detailed drawing of a single electrical terminal 40 is shown. Specifically, a locking hole 49 is shown extending through electrical terminal 40.

As shown in FIG. 1, a locking spacer 50 includes a plurality of fingers 52 with protrusions 54 extending from the distal end of the four center fingers. The fingers at each end of locking spacer 50 do not contain a protrusion 54. The plurality of fingers 52 form a plurality of channels between adjacent fingers. A tab 56 extends outwardly from locking spacer 50. Preferably, locking spacer 50 is manufactured from a plastic material such as polypropylene. The number of protrusions 54 is equal to the number of slots 16 and the protrusions are in alignment with the slots. Tab 56 is adapted to be inserted into slot 18 on peripheral skirt 12. Channel 58 between adjacent fingers 52 provides for routing wires 42 through spacer 50. The width of each channel 58 is less than the diameter of cable seal 48 and terminal 40. Thus, wires 42 may pass through channel 58, but cable seal 48 and electrical terminal 40 cannot pass through the channel. When installed, locking spacer 50 secures electrical terminals 40 within chambers 20.

Referring to FIG. 6, a plurality of resilient locking arms 34 are provided within connector body 10. Each locking arm 34 contains a pair of protrusions 36 extending in opposite directions. A V-shaped notch 38 is formed in locking arm 34 between protrusions 36. Protrusions 36 are adapted to be inserted into locking hole 49 in electrical terminal 40, thereby securing the electrical terminal within connector body 10.

Referring to FIG. 9, an assembled grounding connector may be attached to a grounding surface 78 having an aperture 80. The grounding connector is attached using a bolt 82 mounted through aperture 76 and aperture 80. Alternatively, the grounding connector may be secured to grounding surface 78 using a mounting screw, rivet, or other mounting mechanism as will be known to those skilled in the art.

Referring to FIG. 10, an alternate terminal locking mechanism is illustrated using a wedge-shaped spacer 84. Wedge-shaped spacer 84 has a tapered edge 86 which is adapted to be inserted into the V-shaped notch 38 in locking arm 34. FIG. 11 illustrates the alternate wedge-shaped spacer 84 having tapered edge 86.

In the preferred embodiment, the inventive waterproof grounding connector is assembled and mounted in the following manner. Each of the electrical terminals 40 is inserted into a chamber 20. Since all electrical terminals 40 will be electrically connected together, it is not important which chamber receives a particular electrical terminal. Referring to FIG. 6, as each electrical terminal 40 is inserted into chamber 20, resilient locking arm 34 is deflected by electrical contact portion 46 of electrical terminal 40. If no electrical terminal 40 is inserted into the chamber on the opposite side of locking arm 34, then the locking arm is deflected into that vacant chamber. If an electrical terminal 40 is inserted in the adjacent chamber, the resilient locking arm is compressed into the V-shaped notch 38, thereby allowing the electrical terminal to slide along protrusion 36. As electrical terminal 40 is further inserted into chamber 20, locking hole 49 in electrical terminal 40 will align with protrusion 36, causing resilient locking arm 34 to return to its original shape. The engagement between protrusion 36 and locking hole 49 secures the electrical terminal 40 within the chamber. The remaining electrical terminals 40 are inserted into vacant chambers 20 using the same procedure.

Referring to FIG. 1, after all electrical terminals 40 have been inserted into chambers 20, locking spacer 50 is secured to peripheral skirt 12. Locking spacer So is aligned such that wires 42 slide into channels 58 located between adjacent fingers 52. Next, protrusions 54 are inserted into corresponding slots 16 in peripheral skirt 12. Finally, spacer 50 is urged downwardly against connector body 10, thereby causing tab 56 to snap into slot 18. The engagement between slots 16, 18 and protrusions 54 and tab 56 securely lock the spacer within the peripheral skirt. The locking spacer maintains electrical terminals 40 and cable seals 48 within chambers 20 in the presence of vibration and tension on wires 42. The use of locking spacer 50 in conjunction with resilient locking arm 34 provides a dual locking system to secure terminals 40 within chambers 20.

After terminals 40 and spacer 50 have been secured within connector body 10, grommet 60 is inserted into shroud 14. Since grommet 60 is larger than the shroud opening, the grommet must be compressed and urged into the shroud opening. The compression of grommet 60 creates a resilient outward force which urges peripheral ridges 62 against internal shroud surface 32, thereby creating a water-tight seal between the grommet and the internal shroud surface.

Busbar 68 is then aligned with grommet 60 such that blades 72 are in alignment with slots 66. Busbar 68 is then urged against grommet 60, causing blades 72 to enter slots 66. As blades 72 are inserted through slots 66, grommet 60 is further urged outwardly, thereby improving the seal between peripheral ridges 62 and the internal shroud surface 32. Additionally, as blades 72 are urged through slots 66, grommet 60 is compressed against blades 72, forming a seal between grommet 60 and busbar 68. As blades 72 pass through grommet 60, they enter chambers 20 and engage electrical contact portion 46 of electrical terminal 40. The assembly of grommet 60 and busbar 68 into shroud 14 is illustrated in FIGS. 3 and 4 and FIGS. 7 and 8. Since electrical terminals 40 are secured within chambers 20 by the resilient locking arm 34 and locking spacer 50, insertion of busbar 68 does not force the electrical terminals out of the chambers. When fully inserted, base portion 70 of busbar 68 is disposed against grommet 60. Mounting tab 74 extends through notch 22 in shroud 14.

Figure 4:
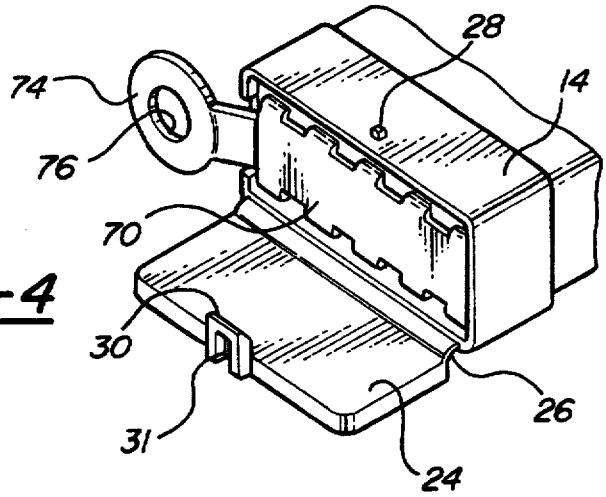
FIG. 4 is a perspective view of the assembled connector with the cover in the open position.

As shown in FIGS. 4 and 5, cover 24 is pivoted from the open position to the closed position. As cover 24 nears the closed position, latch 30 is deflected outwardly as it slides over projection 28. When aperture 31 in latch 30 aligns with projection 28, the latch returns to its original shape, thereby securing cover 24 in the closed position. Cover 24 acts to secure grommet 60 and busbar 68 within connector body 10. Also, cover 24 prevents water or other contaminants from entering the connector body.

Finally, the assembled grounding connector is attached to grounding surface 78 using a bolt 82 or similar mounting apparatus, as illustrated in FIG. 9.

To open cover 24, latch 30 is pulled away from shroud 14 until it clears lock projection 28, at which point the cover may be pivoted to the open position. Cover 24 may be repeatedly opened and closed without reducing the effectiveness of hinge 26 or latch 30.

In the alternate locking structure shown in FIG. 10, wedge-shaped spacer 84 is inserted into connector body 10 after insertion of electrical terminals 40, but before insertion of grommet 60 or busbar 68. Grommet 60 maintains wedge-shaped spacer 84 within the V-shaped notch of locking arm 34. Spacer 84 prevents locking arm 34 from being deflected, thereby preventing release of the electrical terminals. Thus, spacer 84 is used in place of locking spacer 50 to provide a dual locking system to secure the terminals within the chambers.

Although a particular embodiment of the present invention has been described and illustrated as having positions for eight electrical terminals, it will be understood that any number and size of terminals may be used with a corresponding number and size of chambers and blades. Furthermore, the shape of the shroud and grommet has been shown to be generally rectangular, but may have any shape such as a circle, ellipse, or square depending on the particular application. Additionally, other types of locking mechanisms may be used to secure the electrical terminals within the chambers, as will be known to those skilled in the art.

Furthermore, those skilled in the art will appreciate that other securing devices may be used to maintain the grommet and busbar within the shroud. Instead of cover 24, one or more locking clips may be attached to the shroud. Additionally, a locking spacer similar to spacer 50 may be used to secure the grommet and busbar within the shroud. Such a spacer would not require channels 58 since no wires extend from the shroud-end of the connector.

I claim:

1. A waterproof grounding connector securable to a grounding surface and adapted to receive a plurality of electrical terminals in sealing engagement therewith, said waterproof grounding connector comprising:

a connector body having opposite first and second ends, and a plurality of parallel, longitudinal chambers extending through said connector body from said first end to said second end, each chamber opening in a transverse surface defined at said second end and adapted to receive one of said electrical terminals;

a lock means for securing said electrical terminals within said chambers;

a hollow, peripheral shroud defined proximate said second end of said connector body and extending beyond said transverse surface to provide an enclosure defined at one end thereof by said transverse surface, open at its other end, and having an internal peripheral surface extending between the transverse surface and the open end;

a flexible grommet having a continuous peripheral edge and adapted to be inserted into said shroud enclosure for creating a continuous peripheral seal between said peripheral grommet edge and said internal shroud surface, said grommet having a first transverse surface seated against the transverse surface of said connector body and including a plurality of slots corresponding to and in alignment with said chambers;

a conductive busbar including a base portion positioned within said enclosure and seated against a second transverse surface of said grommet, a plurality of blades extending perpendicularly from said base portion and penetrating through said grommet slots in sealing relation, and a mounting tab extending from said base portion for mounting said busbar to said grounding surface, said blades corresponding to and in alignment with said chambers such that said blades engage said electrical terminals secured within said chambers;

a cover attached to said shroud and movable between an open position providing access to said enclosure and a closed position wherein said cover closes the open end of said enclosure to enclose said grommet and said bus bar within said enclosure; and aperture means operative with said cover in said closed position for allowing said mounting tab to extend from inside said enclosure to a location outside of said shroud for connection to the grounding surface.

2. The apparatus of claim 1 wherein said lock means comprises a locking spacer adapted to engage said first end of said connector body and secure said electrical terminals within said chambers.

3. The apparatus of claim 1 wherein said lock means comprises a locking spacer having a base portion, a plurality of fingers extending perpendicularly from said base portion, a tab extending from said base portion, and a protrusion extending from the distal end of each finger.

4. The apparatus of claim 3 wherein said connector body further includes a peripheral skirt located at said first end of said connector body, said peripheral skirt, having a plurality of apertures adapted to receive said locking spacer tab and said locking spacer protrusions in a securing engagement.

5. The apparatus of claim 1 wherein said lock means comprises a plurality of resilient locking arms disposed within said connector body and engageable with said electrical terminals for securing said electrical terminals within said chambers.

6. The apparatus of claim 5 wherein each electrical terminal contains a locking aperture formed therein, each resilient locking arm further includes an outwardly extending protrusion adapted to securely engage said electrical terminal locking aperture.

7. The apparatus of claim 1 wherein said lock means comprises:

a plurality of resilient locking arms disposed within said connector body and engageable with said electrical terminals for securing said electrical terminals within said chambers; and a locking spacer adapted to engage said first end of said connector body and secure said electrical terminals within said chambers.

8. The apparatus of claim 1 wherein said flexible grommet is slightly larger than said shroud enclosure to create a tight seal between said grommet and said internal shroud surface.

9. The apparatus of claim 1 wherein said grommet further includes a pair of parallel, spaced apart continuous peripheral ridges extending outwardly from said peripheral grommet edge for providing a waterproof seal between said grommet and said internal shroud surface.

10. The apparatus of claim 9 wherein said peripheral ridges define a continuous peripheral channel located therebetween.

11. The apparatus of claim 1 wherein insertion of said busbar blades through said grommet slots urges the grommet outwardly against the internal shroud surface to improve said sealing engagement between said peripheral grommet edge and said internal shroud surface.

12. The apparatus of claim 1 further comprising:

a hinge integrally molded between said shroud and said cover;

a lock projection extending outwardly from said shroud; and a latch extending outwardly from said cover and defining an aperture adapted to engage said lock projection and secure said cover to said shroud enclosure in the closed position.

13. The apparatus of claim 1 wherein said aperture means comprises a notch formed in said shroud in a position allowing said busbar mounting tab to project through said notch and exit said enclosure when said cover is in the closed position.

14. A method of assembling a waterproof grounding connector and attaching the connector to a grounding surface, the connector including a connector body, a plurality of electrical terminals, a flexible grommet having a continuous peripheral edge and a plurality of slots therethrough, a conductive busbar, and a cover movable between open and closed positions, the connector body having opposite first and second ends and a plurality of parallel longitudinal chambers extending through said connector body from said first end to said second end, each chamber opening in a transverse surface defined at said second end and adapted to receive one of said electrical terminals, the busbar including a base portion, a plurality of blades extending perpendicularly from said base portion and a mounting tab extending from said base portion, said method comprising the steps of:

providing a hollow, peripheral shroud defined proximate said second end of said connector body and extending beyond said transverse surface to provide an enclosure defined at one end thereof by said transverse surface, open at its other end, and having an internal peripheral surface extending between the transverse surface and the open end;

inserting each of said electrical terminals into one of said longitudinal chambers;

inserting said grommet into said shroud enclosure to create a continuous peripheral seal between said peripheral grommet edge and said internal shroud surface with a first transverse surface of the grommet seated against the transverse surface of the connector body;

seating the base portion of the busbar against a second, opposite transverse surface of said grommet while inserting the blades of said busbar through said grommet slots such that said busbar blades penetrate said grommet slots and engage said electrical terminals;

moving said cover to said closed position to secure said grommet and said busbar within said enclosure;

providing aperture means operative for allowing said mounting tab to extend from inside said enclosure to a location outside of said shroud with the cover in said closed position; and attaching the mounting tab to the grounding surface.

15. The method of claim 14 further including the step of locking said electrical terminals within said longitudinal chambers.

16. The method of claim 14 wherein the step of inserting said grommet into said shroud enclosure further includes the step of compressing said grommet to reduce the outer dimensions thereof.

17. A waterproof grounding connector securable to a grounding surface and adapted to receive a plurality of electrical terminals in sealing engagement therewith, said waterproof grounding connector comprising:

a connector body having opposite first and second ends, and a plurality of parallel, longitudinal chambers extending through said connector body from said first end to said second end, each chamber adapted to receive one of said electrical terminals;

a plurality of resilient locking arms disposed within said connector body and engageable with said electrical terminals for securing said electrical terminals within said chambers, each locking arm having a V-shaped notch formed therein; and a locking spacer having a tapered edge adapted to be inserted into said V-shaped notch for securing said resilient locking arms in engagement with said terminals.

* * * * *